US007463995B2

(12) United States Patent
Stansbury

(10) Patent No.: US 7,463,995 B2
(45) Date of Patent: Dec. 9, 2008

(54) SYSTEMS AND METHODS FOR DETECTING SUCTION VALVE CLOSURE

(75) Inventor: Rodney Scott Stansbury, Santa Fe, TX (US)

(73) Assignee: General Electric Company, Schenectady, NY (US)

( * ) Notice: Subject to any disclaimer, the term of this patent is extended or adjusted under 35 U.S.C. 154(b) by 302 days.

(21) Appl. No.: 11/307,438

(22) Filed: Feb. 7, 2006

(65) Prior Publication Data

US 2007/0185592 A1 Aug. 9, 2007

(51) Int. Cl.
*G06F 15/00* (2006.01)
*G01N 7/00* (2006.01)

(52) U.S. Cl. ..... 702/138; 702/105; 702/182; 702/189; 701/115

(58) Field of Classification Search ..... 702/33, 702/105, 138, 182, 189; 701/115–117
See application file for complete search history.

(56) References Cited

U.S. PATENT DOCUMENTS

2005/0021220 A1* 1/2005 Nakamura et al. ..... 701/115
2005/0114044 A1* 5/2005 Hala et al. ..... 702/33
2005/0180868 A1* 8/2005 Miller ..... 417/437

* cited by examiner

*Primary Examiner*—Eliseo Ramos-Feliciano
*Assistant Examiner*—Phuong Huynh
(74) *Attorney, Agent, or Firm*—Sutherland Asbill & Brennan LLP

(57) ABSTRACT

This invention relates generally to the application of an algorithm to calculate a line that intersects a dynamic pressure waveform at two points. These points represent the point immediately prior to the suction valve closure event and the point directly after the event. The distance between each sample on the dynamic pressure waveform and the corresponding sample on the calculated line is determined. The suction valve closure event is identified with the sample located at the furthest distance from the calculated line.

9 Claims, 6 Drawing Sheets

SYSTEMS AND METHODS FOR DETECTING SUCTION VALVE CLOSURE

FIELD OF THE INVENTION

This invention relates generally to the detection of the point at which a suction valve closes during a compression stroke of a reciprocating compressor that utilizes a stepless unloader capacity control device.

DESCRIPTION OF THE RELATED ART

The prior process used to detect the suction valve closure point in a reciprocating compressor is incompatible with newer compressors which have stepless unloader capacity control devices installed. In fact, prior art systems simply make an assumption that the suction valve is closed at the beginning of the compression stroke. Such an assumption is generally valid for compressors with no stepless unloader installed, but become invalid for compressors with an installed stepless unloader. The stepless unloader capacity control device is designed to operate in a reciprocating compressor in such a manner as to mechanically hold the suction valves open for a portion of the compression cycle such that the gas is not compressed, but instead, forced back into the suction manifold of the cylinder and then closed to achieve the desired compression capacity. Generally, this capacity is measured in cubic feet or meters of gas per unit of time.

Unloaders, in general, are used to reduce the output capacity of a reciprocating compressor. Prior to the use of unloaders, a plant might have two reciprocating compressors for a process. One compressor would run at 100% capacity, while the other was shut down to be used as a backup in case the first compressor failed. This created a number of inefficiencies, so new approaches were applied so that both compressors could run simultaneously, each at a capacity less than 100%.

To allow the reciprocating compressors to operate at a lower capacity, they are fitted with unloaders. The most common ones were fixed unloaders that might have the ability to make a compressor run at 25%, 50%, or 75%. However, in order to change from one level of capacity to another, the compressor had to be shut down. Newer stepless unloaders have the ability to dynamically change capacity without a shutdown. It is done on the fly and can be changed several times a day if necessary.

The prior art process assumes that the head-end suction valve will be closed when the piston is at bottom dead center and that the crank-end suction valve will be closed when the piston is at top dead center. The use of stepless unloaders invalidates this assumption.

As the prior art process has no means of determining the point at which a suction valve is actually closed, it has no means to provide the correct compensation factors for drawing the theoretical adiabatic plot representing the operation of the compressor. Likewise, the prior art system has no means of correctly computing several required calculated variables that are required for compressor performance and efficiency measurements. Furthermore, existing methods assume that any deviation from the actual and theoretical plots are a result of losses or other problems and not as a result of normal operation, when in fact, they are merely the result of not compensating for delayed valve closure.

The only means known by the present inventors of obtaining fairly accurate performance and efficiency calculations for compressors implementing stepless unloader capacity control devices is for the operator of the compressor to temporarily disable the stepless unloader device. By disabling the stepless unloader device, the compressor will be running at full capacity for the time that the system requires to collect data. There are numerous problems with this approach, one of which being that it is not practical for the machine operator to incorporate a process change which results in a forced upset of the normal operation of that process. A forced process change should only occur on rare occasions and only after the machine operator can justify such a change economically.

A further difficulty with the prior art solution described in the above paragraph is that the approach does not provide adequate indication of how the machine operates under normal conditions. Under normal conditions, the compressors will run at reduced capacity. The prior art solution only provides information about compressor operation while running at full capacity. Such information is much less useful to the operator as it does not provide adequate indication of early warning signals due to machinery problems occurring while the compressor is running at reduced capacity.

Because of the problems inherent in the known system, the operators of compressors implementing the stepless unloader device will only make a forced process change to run at full capacity in two scenarios. One scenario in which this will happen is in the instance that the compressor operator already expects that a problem exists in operation. The other scenario where the operator will make a forced process change is when they are attempting an after the fact analysis of how far a problem has progressed.

Further problems are created by the prior art method. For example, when the machine operator wants to review and interpret historical data concerning the operation of the compressor, the data has become unreliable as there will be periods of irregular operation caused by the forced process changes. Data is stored historically for compressors and the data collected during operating the compressor at full capacity can be easily misinterpreted.

Therefore, a need exists for a system and method for detecting the suction valve closure point in a reciprocating compressor operating with a stepless unloader control device.

SUMMARY OF THE INVENTION

The present invention fulfills these above-described needs through systems and methods which can determine the degree rotation of a compressor crankshaft at which suction valve closure occurs during each compression cycle within one degree. The present invention provides such a method wherein the data is gathered under normal operation of the system and will allow for accurate data compilation. The present invention is much less intrusive than prior art methods and provides more accurate data compilations. Furthermore, the present invention will assist in gathering accurate data for efficiency calculations and to draw the compensated theoretical adiabatic curves.

One aspect of the present invention is the determination that a suction valve of a reciprocating compressor closes at the point where the slope of the compression cycle increases dramatically over a very short interval. In essence, the suction valve closure event is essentially embedded within the dynamic pressure waveform data. The present invention takes an algorithmic approach to solving this problem which involves extracting the event from the waveform.

In an embodiment of the present invention, an algorithm is applied that calculates a line that intersects the dynamic pressure waveform at a point which is known to be above the suction valve closure event. The distance between each sample on the dynamic pressure waveform and the calculated line is determined. The suction valve closure event is associated with the further distance calculated from the line.

DETAILED DESCRIPTION

Figure 1:
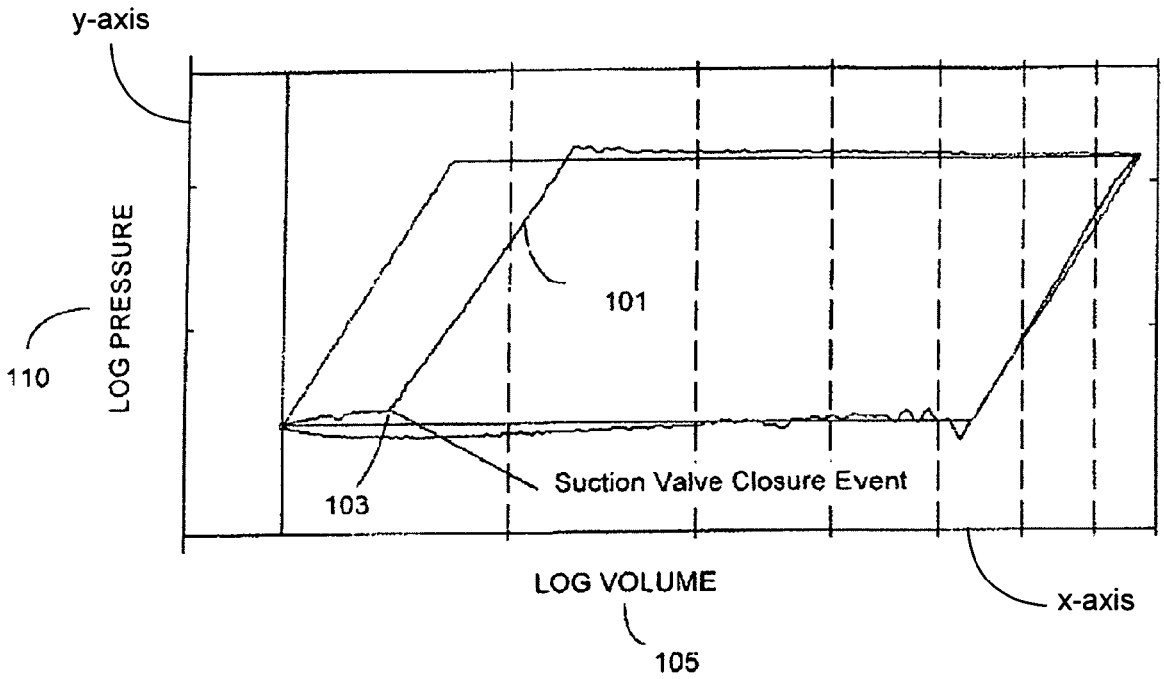
FIG. 1 depicts the slope of a representative compression cycle wherein the suction valve closure event is embedded in the dynamic pressure waveform data in accordance with an embodiment of the present invention.

The present invention now will be described more fully hereinafter with reference to the accompanying drawings, in which some, but not all embodiments of the invention are shown. Indeed, these inventions may be embodied in many different forms and should not be construed as limited to the embodiments set forth herein; rather, these embodiments are provided so that this disclosure will satisfy applicable legal requirements. Like numbers refer to like elements throughout.

The present invention is described below with reference to block diagrams and flowchart illustrations of systems, methods, apparatuses and computer program products according to an embodiment of the invention. It will be understood that each block of the block diagrams and flowchart illustrations, and combinations of blocks in the block diagrams and flowchart illustrations, respectively, can be implemented by computer program instructions. These computer program instructions may be loaded onto a general purpose computer, special purpose computer, or other programmable data processing apparatus to produce a machine, such that the instructions which execute on the computer or other programmable data processing apparatus create means for implementing the functions specified in the flowchart block or blocks.

These computer program instructions may also be stored in a computer-readable memory that can direct a computer or other programmable data processing apparatus to function in a particular manner, such that the instructions stored in the computer-readable memory produce an article of manufacture including instruction means that implement the function specified in the flowchart block or blocks. The computer program instructions may also be loaded onto a computer or other programmable data processing apparatus to cause a series of operational steps to be performed on the computer or other programmable apparatus to produce a computer implemented process such that the instructions that execute on the computer or other programmable apparatus provide steps for implementing the functions specified in the flowchart block or blocks.

Accordingly, blocks of the block diagrams and flowchart illustrations support combinations of means for performing the specified functions, combinations of steps for performing the specified functions and program instruction means for performing the specified functions. It will also be understood that each block of the block diagrams and flowchart illustrations, and combinations of blocks in the block diagrams and flowchart illustrations, can be implemented by special purpose hardware-based computer systems that perform the specified functions or steps, or combinations of special purpose hardware and computer instructions.

For the purposes of illustrating the present invention, it will be assumed that the system is operating with a crank-end cylinder. Furthermore, it is assumed that one pressure sample is determined for each 0.5° of crankshaft rotation. It is also assumed that for crank-end cylinders, the suction valve closures occur at a point between 0° and 180° of crankshaft rotation. It will be well understood to those skilled in the art that the algorithm is equally suitable for use with head-end cylinders and with dynamic pressure waveforms having more or less resolution.

FIG. 1 depicts a plot of a representative compression cycle wherein the suction valve closure event is embedded in the dynamic waveform data. The x-axis 105 is representative of the gas volume of the cylinder. The y-axis 110 is representative of the gas pressure of the cylinder. A representative point at which the suction valve closure event may occur is indicated at 103. The suction valve closes at the point where the slope 101 of the compression cycle increases dramatically over a short time interval. As is inherent in FIG. 1, to determine the point of valve suction closure 103, this event must be extracted from the waveform.

Figure 2:
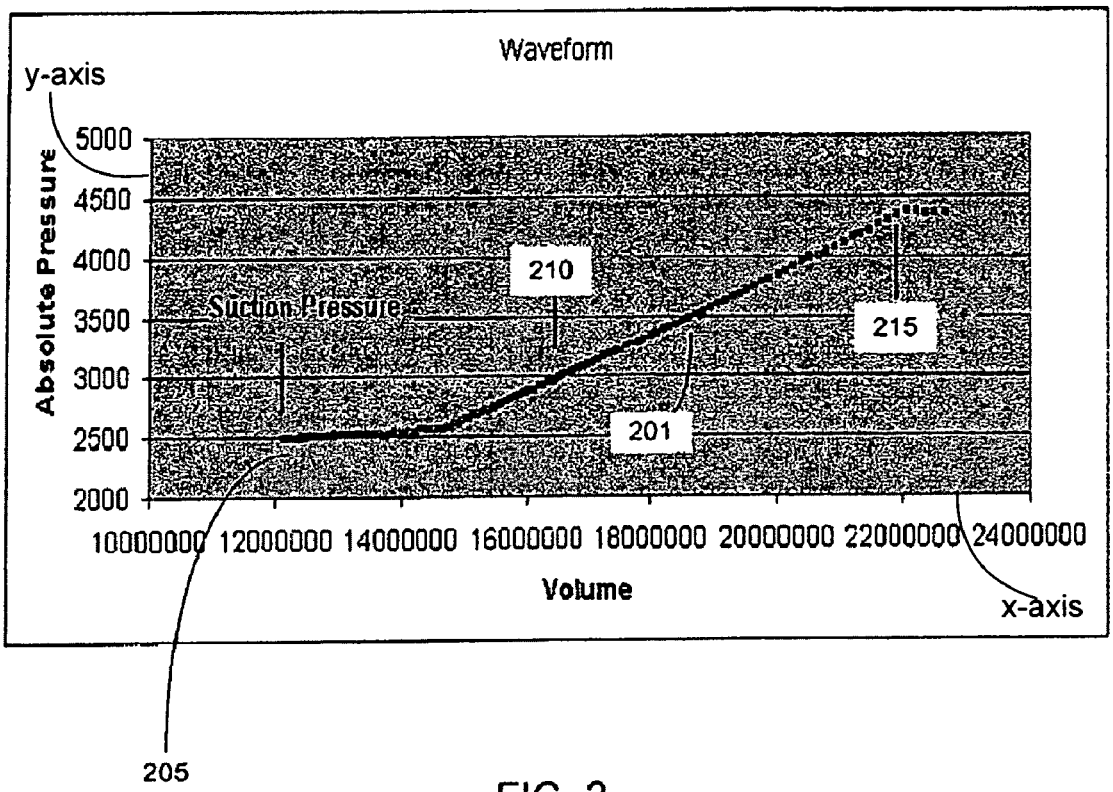
FIG. 2 depicts the waveform comparing absolute pressure created for increasing volumes of gas in accordance with an embodiment of the present invention.

FIG. 2 depicts the waveform comparing absolute pressure created for increasing absolute volumes of gas. An embodiment of the present invention first operates to read in data concerning pressure and volume data and then subsequently stores that data in the system's memory. First, 360 pressure samples are taken. One sample is taken at each 0.5° increment of crankshaft rotation between 0° and 180°. It should be recognized that in different embodiments of the present invention, more or less samples may be taken, and that the accuracy of the method will be affected accordingly.

These samples are stored in an array of pressure values in the memory of the system. These pressure values are represented on the y-axis 220. Two specific pressure values are also herein defined. The discharge pressure value is defined by the pressure sample taken at 180 degrees of crankshaft rotation. The suction pressure is defined by the pressure sample taken at 0 degrees of crankshaft rotation. The location of the sample at which suction pressure is determined is called the suction pressure point 205. Likewise, the volume at each 0.5° increment of crankshaft rotation between 0° and 180° is also determined. These samples are stored as an array of volume values in the memory of the system. Volume values are plotted in accordance with the x-axis 230.

The present invention iterates through each of the stored pressure values for the corresponding sample starting at the sample located at the suction pressure point 205. For each sample it is determined whether the determined pressure value is greater than or equal to the defined discharge pressure. If the current sample's pressure value is greater than or equal to the defined discharge pressure, then the current sample's index location is stored as the sub-discharge pressure sample location 215 in the memory of the system. This represents the waveform sample associated with the point at which the discharge valve opens at the end of the compression cycle.

The waveform 201 begins at the defined suction pressure point 205. The waveform 201 runs through the determined sub-discharge pressure sample location 215. A difference value is calculated as the difference between the discharge pressure and suction pressure. This result is then multiplied by a predetermined factor, for example, 0.25. The result of this multiplication is then added to the suction pressure and stored into the memory of the system. The purpose of applying the predetermined factor is to ensure that the resultant difference value is greater than the pressure value at the suction valve closure event location. For example, difference pressure point 210 illustrates a possible difference value plot location.

An analysis is made of the stored pressure values at each sample between suction pressure point 205 and ending at the determined sub-discharge pressure sample location 215. For each sample, the method compares the sample's pressure value and determines whether that pressure value is greater than or equal to the determined difference value. If the sample is greater than or equal to the determined difference value, that sample's index location is stored as the pressure index location 310 in the memory of the system. The pressure index location 310 is discussed in more detail in the detailed description of FIG. 3 below. Furthermore, if the current sample's pressure value is greater than or equal to the defined difference value, the iteration terminates.

Next, two memory arrays are created. The x-plot array stores the x-plot values corresponding to absolute volume. The y-plot array stores the y-plot values corresponding to absolute pressure. The array size is determined by the result of subtracting the value of the pressure index location 310 from the sub-discharge pressure sample location 215 and adding 1 to determine the appropriate array size.

FIGS. 3*a*, 3*b*, 3*c* and 3*d* depict the waveforms comparing the log scaled pressure for increasing log scaled volumes of gas with the best-fit linear line, the line that has one-half the slope of the best-fit linear line, and the best-fit 6th-order polynomial. A calculation occurs for each of the samples between pressure index location 310 and the previously determined sub-discharge pressure sample location 315. During each iteration, the values for the y-plot array locations are defined as the log scale (base 10) of the pressure value for the corresponding sample. Likewise, the values for the x-plot array locations are defined as the log scale of the volume value for the corresponding sample. Line 300 indicates the log scaled waveform 201, depicted in FIG. 3*a* after application of the log scale. Line 300 runs from suction pressure point 305 through the previously determined sub-discharge pressure sample location 315.

Figure 3A:
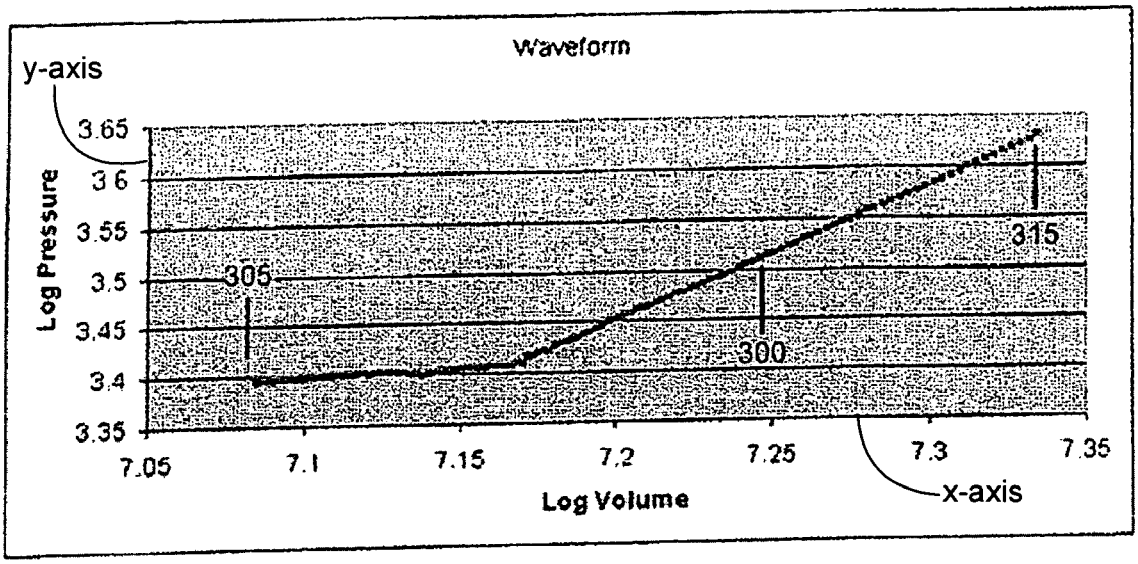
FIG. 3*a* depicts the log-scaled waveform depicted in FIG. 2.
Figure 3B:
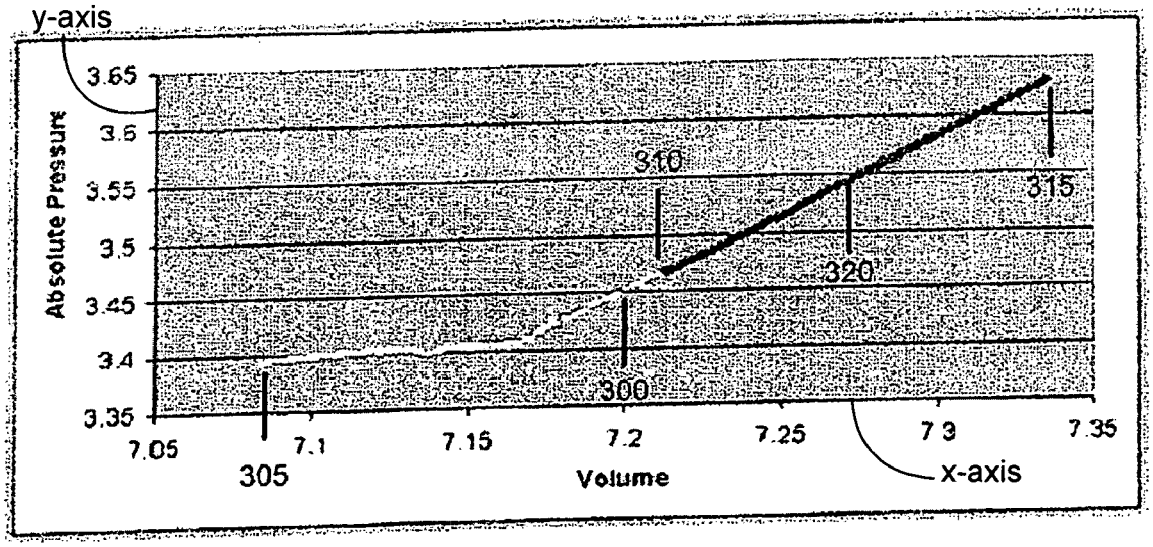
FIG. 3*b* depicts the best-fit linear line as compared to the waveform depicted in FIG. 3*a*.
Figure 3C:
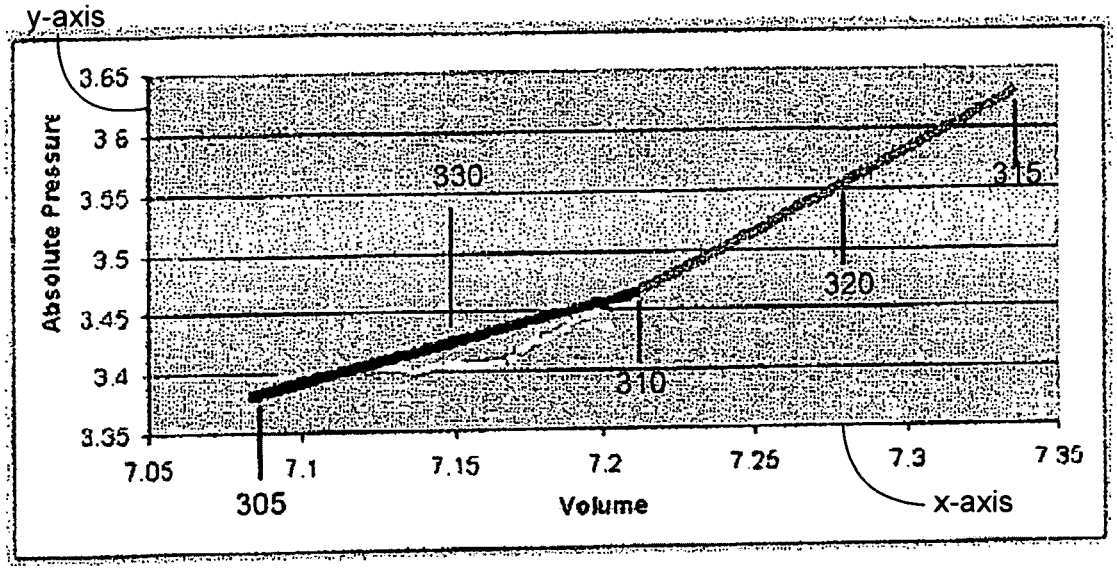
FIG. 3*c* depicts the line that has one-half the slope of the best-fit linear line.

Moving to FIG. 3*b*, the system next determines the best-fit linear line 320 running through pressure index location 310 and the previously determined sub-discharge pressure sample location 315. Subsequently, a second line 330 is shown in FIG. 3*c* which represents the line that has one-half the slope of the best-fit linear line 320. The second line 330 is calculated to intersect the best-fit linear line 320 at a point between pressure index location 310 and the previously determined sub-discharge pressure sample location 310.

Figure 3D:
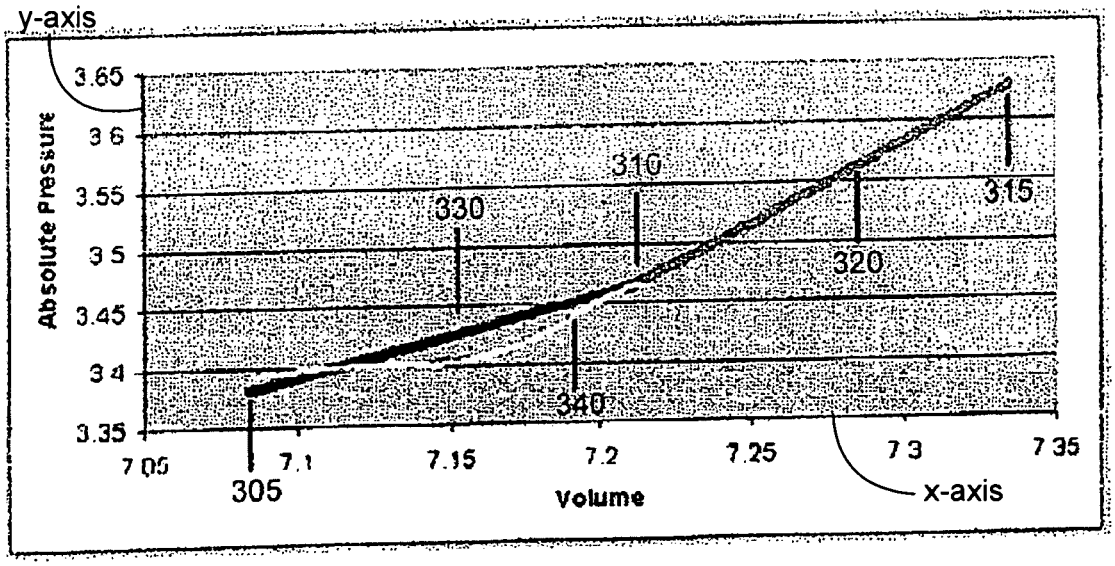
FIG. 3*d* depicts the best-fit 6th-order polynomial highlighted in accordance with an embodiment of the present invention.

Next, FIG. 3*d* illustrates a third line 340 as shown, representing a best-fit 6th-order polynomial. The best-fit 6th-order polynomial line 340 runs through suction pressure point 305 and the pressure index location 310. The purpose of modeling the data with a 6th-order polynomial is to filter out the data.

The coefficients of the second line 330 are determined by the standard form (Ax +By+C). In this case, B may be defined as −1 such that the coefficient A represents the slope of the second line 330, which is one-half the slope of the determined best-fit linear line 320. The coefficient C represents the y-intercept.

The system calculates the coefficients of the best-fit 6th-order polynomial 340 expressed as Ax^6+Bx^5+Cx^4+Dx^3+Ex^2+Fx+G. This polynomial is used in a subsequent iteration through each of the samples between the initial sample (the suction pressure point 305) and the sample defined at the pressure index location 310.

For each sample in the iteration, a point is determined containing an x-value and a y-value. For example, for sample n the equation y(n)=Ax(n)^6+Bx(n)^5+Cx(n)^4+Dx(n)^3+Ex(n)^2+Fx(n)+G is applied. This allows for the determination of the x-y point that follows the best-fit polynomial line 340.

An iteration is then performed from the pressure index location 310 to the sub-discharge pressure sample location 315. For each of the points in the iteration, the distance is determined from each x-y point on the polynomial line to the line Ax+By+C 330. These values are then compared to determine which x-y point has the furthest distance from the line Ax+By+C 330. The result is stored as the target location.

Once the target location is determined, the coefficients of a best-fit 6th-order polynomial running through the sample located at target location −10 and target location +10 are determined. The polynomial takes the form of Ax^6+Bx^5+Cx^4+Dx^3+Ex^2+Fx+G. For each sample location in the iteration, a point is determined containing an x-value and a y-value. For example, for sample n the equation y(n)=Ax(n)^6+Bx(n)^5+Cx(n)^4+Dx(n)^3+Ex(n)^2+Fx(n)+G is applied. This allows for the determination of the x-y points that lie on the best-fit polynomial line.

An iteration is then performed from target location −10 and target location +10. For each of the points in the iteration, the distance is determined from the x-y point on this second polynomial line to the line Ax+By+C 330. These values are then compared to determine which x-y point on the second polynomial line has the furthest distance from the line Ax+By+C 330. The result is stored as the event location. The sample located at this second target location is then correlated to the crankshaft angle at which the suction valve closure event occurs. In other words, if the sample located at this second target location was the sample taken at n degrees of crankshaft rotation, then n degrees is the determined crankshaft angle at which the suction valve closure event occurs.

Figure 4:
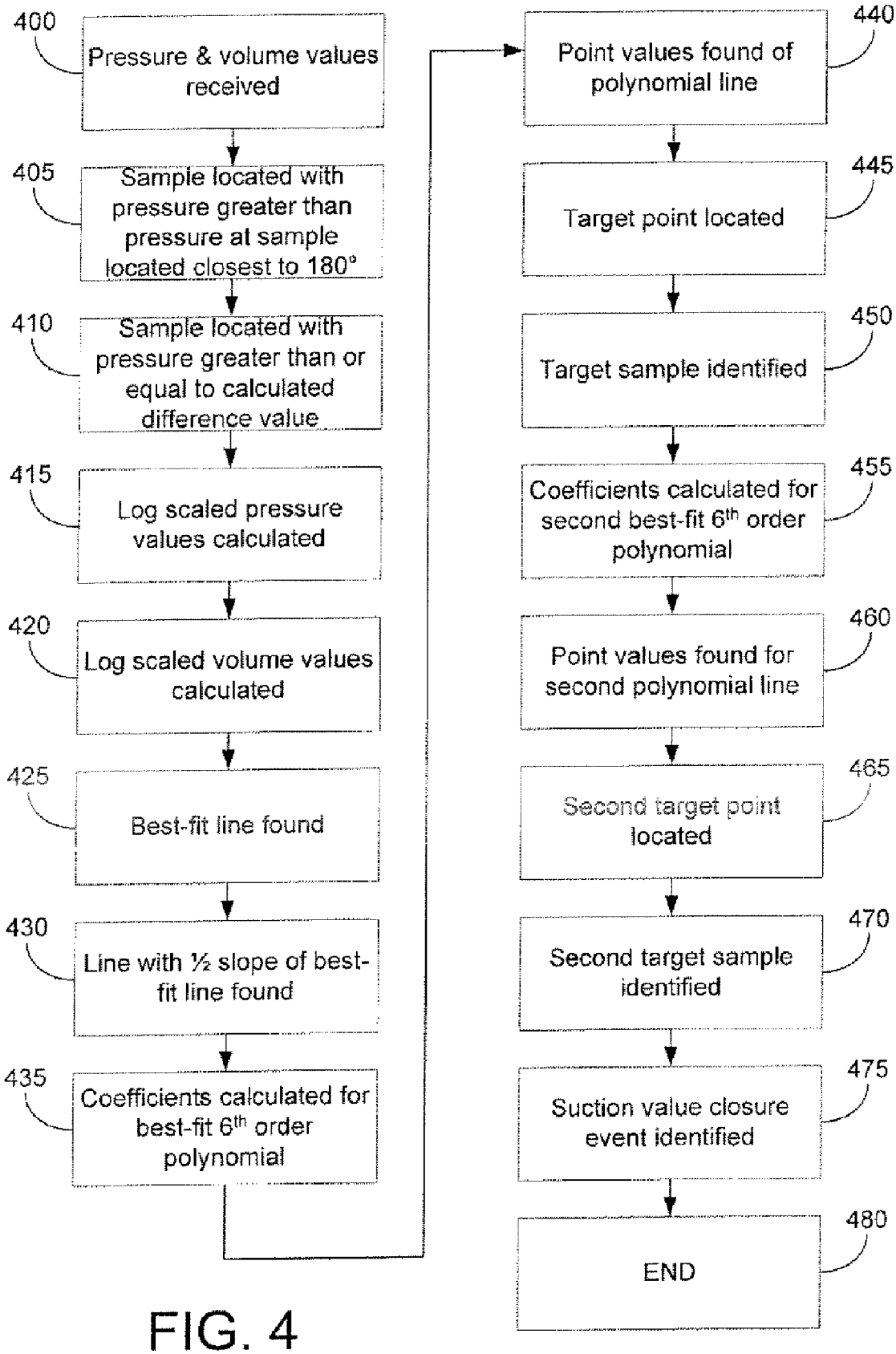
FIG. 4 depicts a flowchart for an exemplary operation according to aspects of the present invention.

FIG. 4 depicts an exemplary operation according to aspects of the present invention. The method begins at step 400 where pressure and volume values for a pre-determined number of samples taken during a compression cycle are received. After these values are received, the method proceeds to step 405 where the sample associated with the discharge pressure is stored in memory. The sample is located 180 degrees from top dead center for crank-end cylinders.

Next, the method proceeds to step 410 where a second sample is located with a pressure value greater than or equal to the suction pressure +[(the discharge pressure−the suction pressure)*N]. For purposes of this illustration, it is assumed that N=0.25. However, N may be of any value between 0 and 1. Also, those skilled in the art will recognize that the algorithm is less accurate if N is too close to either 0 or 1.

The method then proceeds to step 415 where log scaled pressure values for each sample from the sample located in step 410 through the sample located in step 405 are stored. The method subsequently proceeds to step 420 where log scaled volume values for each sample from the sample located in step 410 through the sample located in step 405 are stored.

The method next proceeds to step 425 where a best-fit linear line is calculated which consists of all the pressure waveform samples between the sample located in step 410 through the sample located in step 405. Next, the method proceeds to step 430 where a line with one-half the slope of the best-fit linear line determined in step 425 is found which intersects the best-fit linear line at the value of the sample located in step 410.

The method then proceeds to step 435 where the coefficients are calculated for a best-fit 6th-order polynomial consisting of all the samples between and including top dead center and the sample located in step 410. The method then proceeds to step 440 where y-values are calculated for each x-value in the best-fit 6th-order polynomial determined in step 435 between and including top dead center and the sample located in step 410 such that each y-value is equal to $Ax^6+Bx^5+Cx^4+Dx^3+Ex^2+Fx+G$ where values A, B, C, D, E, F, and G are the coefficients calculated for the best-fit 6th-order polynomial in step 435.

Next, the method proceeds to step 445 where distances are calculated for each point on the polynomial line $Ax^6+Bx^5+Cx^4+Dx^3+Ex^2+Fx+G$ to the best-fit linear line determined in step 430. Subsequently, at step 450 a target sample is defined as the sample associated with the longest distance to the best-fit linear line determined in step 430. This sample should be the sample associated with the exact point at which the suction valve closure event occurs or a point extremely close to it. Thus, the algorithm proceeds to perform a second pass on an interval closer to and centered around the target sample defined in step 450.

Then, at step 455, coefficients are calculated for a second best-fit 6th-order polynomial line consisting of all the points which are located at a pre-determined distance away from the target sample defined in step 450. Next, at step 460, y-values are calculated for each x-value in the best-fit 6th-order polynomial determined in step 455 over the interval consisting of a pre-determined number of samples before and after the target sample defined in step 450 such that the y-value is equal to $Ax^6+Bx^5+Cx^4+Dx^3+Ex^2+Fx+G$ where values A, B, C, D, E, F, and G are the coefficients calculated for the best-fit 6th-order polynomial determined in step 455.

The method then proceeds to step 465 where distances are calculated from each point on the polynomial line $Ax^6+Bx^5+Cx^4+Dx^3+Ex^2+Fx+G$ to the best-fit linear line obtained in step 430. Subsequently, at step 470, a final target sample is defined as the sample associated with the longest distance from the line. The method then proceeds to step 475 where the suction valve closure event is identified as being located at the crankshaft rotation angle corresponding to the final target sample defined in step 470. Finally, the method concludes at step 480.

Figure 5:
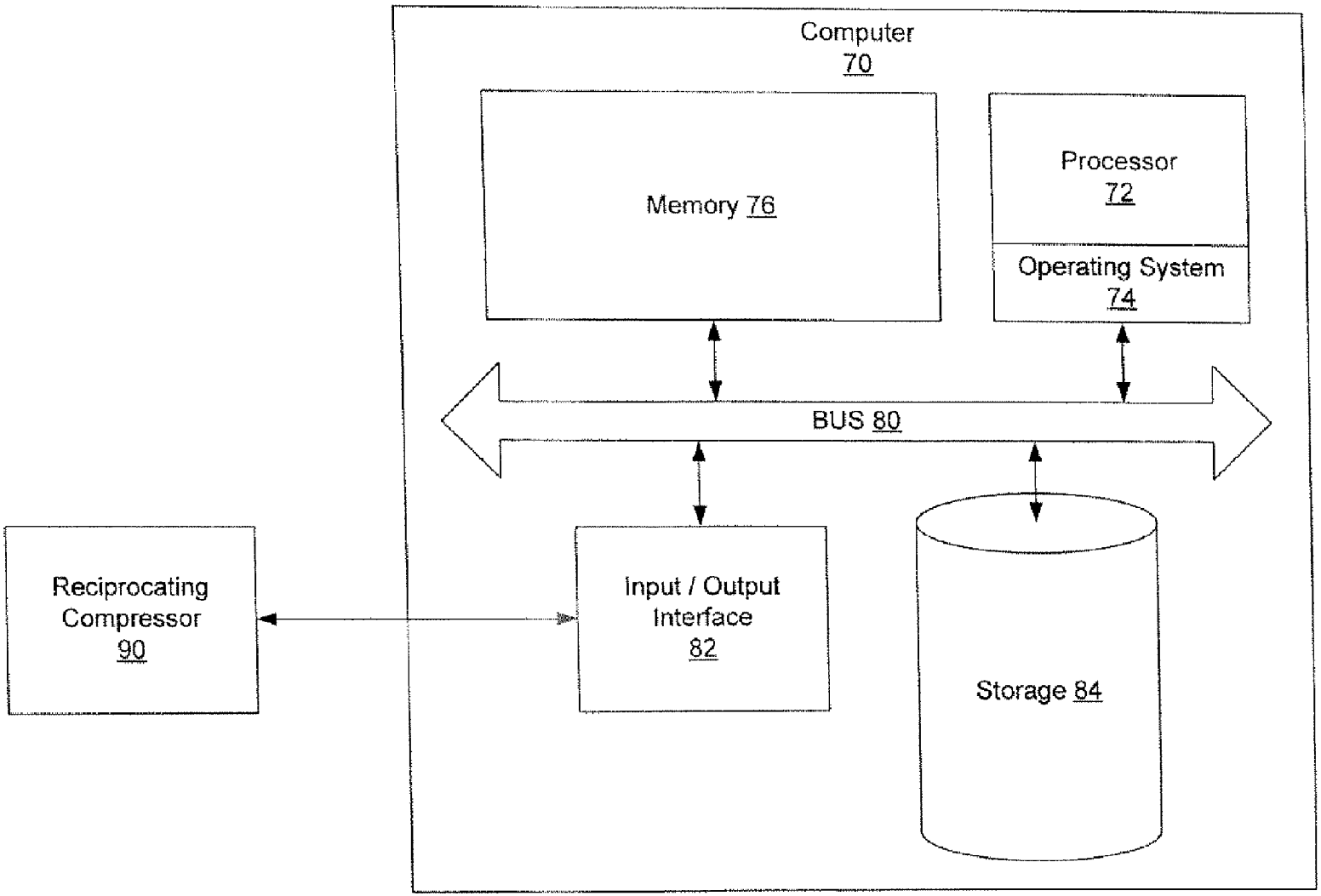
FIG. 5 depicts a block diagram of a computer capable of operating according to one aspect of the present invention.

It will be appreciated that each of the methods described above with respect to FIGS. 2, 3 and 4 may be implemented by computer software and/or hardware, as described next with reference to FIG. 5. FIG. 5 shows a block diagram of a computer 70, according to one aspect of the present invention. The computer 70 generally includes a processor 72, operating system 74, memory 76, input/output (I/O) interface 82, storage 84 and bus 80. The bus 80 includes data and address bus lines to facilitate communication between the processor 72, operating system 74 and the other components within the module 70, including the memory 76, the input/output (I/O) interface 82 and the storage 84. The processor 72 executes the operating system 74, and together the processor 72 and operating system 74 are operable to execute functions implemented by the computer 70, including software applications stored in the memory 76, as is well known in the art. Specifically, to implement the methods described herein with respect to FIGS. 2, 3 and 4, the processor 72 and operating system 74 are operable with the I/O interface 82 to obtain the pressure and volume values needed from a reciprocating compressor 90. According to one aspect of the invention, memory 76 may include one or more algorithms for executing the methods and processes described above with respect to FIGS. 2, 3 and 4.

It will be appreciated that the memory 76 may include random access memory, read-only memory, a hard disk drive, a floppy disk drive, a CD-Rom drive, or optical disk drive, for storing information on various computer-readable media, such as a hard disk, a removable magnetic disk, or a CD-ROM disk. Generally, the memory 76 receives information input or received by the computer 70, including pressure and volume values from the compressor through I/O interface 82. Using information it receives, the memory 76 effects the methods described in detail above with respect to FIGS. 2, 3 and 4 to determine a suction valve closure event. Therefore, the memory 76 may be operable to execute computations of parameters, compare the parameters against criteria, process information, and the like, as needed to execute the methods described herein.

The storage 84 of the computer 70, which is connected to the bus 80 by an appropriate interface, may include random access memory, read-only memory, a hard disk drive, a floppy disk drive, a CD-Rom drive, or optical disk drive, for storing information on various computer-readable media, such as a hard disk, a removable magnetic disk, or a CD-ROM disk. In general, the purpose of the storage 84 is to provide non-volatile storage to the computer 70. The storage may include one or more criteria against which the calculated parameters may be compared against.

It is important to note that the computer-readable media described above with respect to the memory 76 and storage 84 could be replaced by any other type of computer-readable media known in the art. Such media include, for example, magnetic cassettes, flash memory cards, digital video disks, and Bernoulli cartridges. It will be also appreciated by one of ordinary skill in the art that one or more of the computer 70 components may be located geographically remotely from other computer 70 components.

It should also be appreciated that the components illustrated in FIG. 5 support combinations of means for performing the specified functions described herein. As noted above, it will also be understood that each of the methods described above, including the processes and computations described with reference to FIGS. 2, 3 and 4, can be implemented by special purpose hardware-based computer systems that perform the specified functions or steps, or combinations of special purpose hardware and computer instructions. Further, the computer 70 may be embodied as a data processing system or a computer program product on a computer-readable storage medium having computer-readable program code means embodied in the storage medium. Any suitable computer-readable storage medium may be utilized including hard disks, CD-ROMs, DVDs, optical storage devices, or magnetic storage devices. Additionally, although illustrated individually in FIG. 5, each component of the computer 70 may be combined with other components within the computer 70 to effect the functions described herein. Accordingly, the computer 70 may take the form of an entirely hardware embodiment, an entirely software embodiment or an embodiment combining software and hardware aspects, such as firmware.

Many modifications and other embodiments of the inventions set forth herein will come to mind to one skilled in the art to which these inventions pertain having the benefit of the teachings presented in the foregoing descriptions and the associated attachments. Therefore, it is to be understood that the inventions are not to be limited to the specific embodiments disclosed and that modifications and other embodiments are intended to be included within the scope of the present disclosure. Although specific terms are employed herein, they are used in a generic and descriptive sense only and not for purposes of limitation.

What is claimed is:

1. A method of identifying suction valve closure in a reciprocating compressor, comprising the steps of:

receiving pressure and volume values for a pre-determined number of samples taken during a compression cycle;

locating a first sample with a pressure value greater than a pressure value of the sample taken closest to 180 degrees of a crankshaft rotation;

locating a second sample with a pressure value greater than or equal to a pressure value defined as [(the pressure value of the sample taken closest to 180 degrees of the crankshaft rotation−a pressure value of a sample taken closest to 0 degrees of the crankshaft rotation)*a factor less than 1]+ the pressure value of the sample taken closest to 0 degrees of the crankshaft rotation;

storing log scaled pressure values for at least some of the samples;

storing log scaled volume values for at least some of the samples;

determining a best-fit linear line running through a first location corresponding to the second sample and a second location corresponding to the first sample, where each location comprises an x-value equal to the log scaled volume value of the sample and a y-value equal to the log scaled pressure value of the sample;

determining a second line with one-half a slope of the best-fit linear line, wherein the second line intersects the best-fit linear line at the first location;

calculating a second line solution for at least some of the locations, wherein the second line solution is a solution to the second line determined using the x-value of the location;

calculating first best-fit coefficients of a first best-fit 6th-order polynomial running through a third location, corresponding to the sample taken closest to 0 degrees of the crankshaft rotation, and the second location;

calculating a first best-fit 6th-order polynomial solution for at least some of the locations, wherein the first best-fit 6th order polynomial solution is equal to $Ax^6+Bx^5+Cx^4+Dx^3+Ex^2+Fx+G$ where A, B, C, D, E, F, and G are the first best-fit coefficients of the first best-fit 6th-order polynomial and x is the x-value of the location;

determining a first target location, the first target location having a maximum difference between the first best-fit 6th-order polynomial solution for the location and the corresponding second line solution for the location, the first target location being between the second location and the first location;

defining a first target sample as the sample associated with the first target location;

calculating second best-fit coefficients of a second best-fit 6th-order polynomial running through a fourth location, located a pre-determined number of locations prior to the first target location, and a fifth location, located a pre-determined number of locations after the first target location;

calculating a second best-fit 6th-order polynomial solution for locations between the fourth location and the fifth location, wherein the second best-fit 6th-order polynomial solution is equal to $Hx^6+Ix^5+Jx^4+Kx^3+Lx^2+Mx+N$ where H, I, J, K, L, M, and N are the second best-fit coefficients of the second best-fit 6th-order polynomial and x is the x-value of the location;

determining a second target location, the second target location having a maximum difference between the second best-fit 6th-order polynomial solution for the location and the corresponding second line solution for the location, the second target location being between the fourth location and the fifth location;

defining a second target sample as the sample associated with the second target location;

identifying the suction valve closure event as being located at the crankshaft rotation angle corresponding to the second target sample.

2. The method of claim 1 where the reciprocating compressor is operating with a stepless unloader capacity control device.

3. The method of claim 1 where the suction valve closure event is for a crank-end cylinder.

4. The method of claim 1 where the suction valve closure event is for a head-end cylinder.

5. A system for identifying suction valve closure in a reciprocating compressor, comprising:

means for receiving pressure and volume values for a pre-determined number of samples taken during a compression cycle;

means for locating a first sample with a pressure value greater than a pressure value of the sample taken closest to 180 degrees of a crankshaft rotation;

means for locating a second sample with a pressure value greater than or equal to a pressure value defined as [(the pressure value of the sample taken closest to 180 degrees of the crankshaft rotation−a pressure value of a sample taken closest to 0 degrees of the crankshaft rotation)*a factor less than 1]+ the pressure value of the sample taken closest to 0 degrees of the crankshaft rotation;

means for storing log scaled pressure values for at least some of the samples;

means for storing log scaled volume values for at least some of the samples;

means for determining a best-fit linear line running through a first location corresponding to the second sample and a second location corresponding to the first sample, where each location comprises an x-value equal to the log scaled volume value of the sample and a y-value equal to the log scaled pressure value of the sample;

means for determining a second line with one-half a slope of the best-fit linear line, wherein the second line intersects the best-fit linear line at the first location;

means for calculating a second line solution for at least some of the locations, wherein the second line solution is a solution to the second line determined using the x-value of the location;

means for calculating first best-fit coefficients of a first best-fit 6th-order polynomial running through a third location, corresponding to the sample taken closest to 0 degrees of the crankshaft rotation, and the second location;

means for calculating a first best-fit 6th-order polynomial solution for at least some of the locations, wherein the first best-fit 6th order polynomial solution is equal to $Ax^6+Bx^5+Cx^4+Dx^3+Ex^2+Fx+G$ where A, B, C, D, E, F, and G are the first best-fit coefficients of the first best-fit 6th-order polynomial and x is the x-value of the location;

means for determining a first target location, the first target location having a maximum difference between the first best-fit 6th-order polynomial solution for the location and the corresponding second line solution for the location, the first target location being between the second location and the first location;

means for defining a first target sample as the sample associated with the first target location;

means for calculating second best-fit coefficients of a second best-fit 6th-order polynomial running through a fourth location, located a pre-determined number of locations prior to the first target location, and a fifth location, located a pre-determined number of locations after the first target location;

means for calculating a second best-fit 6th-order polynomial solution for locations between the fourth location and the fifth location, wherein the second best-fit 6th-order polynomial solution is equal to $Hx^6+Ix^5+Jx^4+Kx^3+Lx^2+Mx+N$ where values H, I, J, K, L, M, and N are the second best-fit coefficients of the second best-fit 6th-order polynomial and x is the x-value of the location;

means for determining a second target location, the second target location having a maximum difference between the second best-fit 6th-order polynomial solution for the location and the corresponding second line solution for the location, the second target location being between the fourth location and the fifth location;

means for defining a second target sample as the sample associated with the second target location;

means for identifying the suction valve closure event as being located at the crankshaft rotation angle corresponding to the second target sample.

6. The system of claim 5 where the reciprocating compressor is operating with a stepless unloader capacity control device.

7. The system of claim 6 where the suction valve closure event is for a crank-end cylinder.

8. The system of claim 6 where the suction valve closure event is for a head-end cylinder.

9. A method of identifying a crankshaft rotation angle associated with closure of a suction valve, the method comprising:

receiving a pressure value and a volume value for each of a plurality of samples taken during a compression cycle, the samples comprising:

a suction sample taken when the crankshaft rotation angle is about 0 degrees, a discharge sample taken when the crankshaft rotation angle is about 180 degrees, and an index sample taken when the crankshaft rotation angle is between 0 and 180 degrees;

representing at least some of the samples as points, each point comprising an x-value and a y-value, wherein the x-value is the log of the volume value of the sample and the y-value is the log of the pressure value of the sample, the points comprising a suction point corresponding to the suction sample, a discharge point corresponding to the discharge sample, and an index point corresponding to the index sample;

determining a best-fit linear line from about the index point to about the discharge point;

determining a second linear line, the second linear line having a second linear line slope that is about one-half of a best-fit linear line slope, the second linear line intersecting the best-fit linear line at about the index point;

determining a best-fit polynomial line from about the suction point through about the index point;

for each point between about the index point and about the discharge point, using the x-value of the point to determine a distance between the best-fit linear line and the best-fit polynomial line;

comparing the distances to identify a maximum distance point associated with a maximum distance between the best-fit linear line and the best-fit polynomial line;

identifying a suction valve closure sample, the maximum distance point representing the suction valve closure sample; and determining that the suction valve closes when the crankshaft is at a crankshaft rotation angle that is about the same as a crankshaft rotation angle at which the suction valve closure sample was taken.

* * * * *